US007204733B2

(12) United States Patent
Nash et al.

(10) Patent No.: US 7,204,733 B2
(45) Date of Patent: Apr. 17, 2007

(54) DUCT STRUCTURE FOR WATERCRAFT

(75) Inventors: Chester Colburn Nash, Fayetteville, GA (US); Michael Augustin Curtin, Newnan, GA (US)

(73) Assignee: Yamaha Motor Manufacturing Corporation of America, Newnan, GA (US)

( * ) Notice: Subject to any disclaimer, the term of this patent is extended or adjusted under 35 U.S.C. 154(b) by 0 days.

(21) Appl. No.: 10/972,586

(22) Filed: Oct. 25, 2004

(65) Prior Publication Data

US 2006/0089065 A1 Apr. 27, 2006

(51) Int. Cl.
*B63B 35/73* (2006.01)

(52) U.S. Cl. ..... 440/88 A

(58) Field of Classification Search ..... 440/88 A; 277/606, 616, 626; 285/39, 149.1, 154.1
See application file for complete search history.

(56) References Cited

U.S. PATENT DOCUMENTS

| | | | | |
|---|---|---|---|---|
| 3,243,206 | A * | 3/1966 | Samer | 285/154.1 |
| 4,302,035 | A * | 11/1981 | Ochwat | 285/149.1 |
| 4,426,095 | A * | 1/1984 | Buttner | 277/606 |
| 5,029,879 | A * | 7/1991 | Strang et al. | 277/606 |
| 5,954,345 | A * | 9/1999 | Svoboda et al. | 277/626 |
| 6,139,381 | A * | 10/2000 | Suzuki et al. | 440/88 A |
| 6,471,558 | B1 | 10/2002 | Nakatsuji et al. | |

* cited by examiner

*Primary Examiner*—Lars A. Olson
(74) *Attorney, Agent, or Firm*—Keating & Bennett, LLP

(57) ABSTRACT

A duct structure for a watercraft includes a flexible tube for providing an air intake for the watercraft and a flexible member for being disposed on an inner perimeter of a hole in a hull of the watercraft for holding the flexible tube. A convex portion of the flexible tube engages at least one concave portion of the flexible member around substantially the entire circumference of the flexible member, allowing for easy insertion and removal of the flexible tube from the flexible member.

33 Claims, 6 Drawing Sheets

DUCT STRUCTURE FOR WATERCRAFT

BACKGROUND OF THE INVENTION

1. Field of the Invention

The present invention relates to a duct structure for watercraft. More specifically, the present invention relates to a duct structure for an air intake duct for watercraft.

2. Description of the Related Art

Personal watercraft have become very popular in recent years. This type of watercraft is quite sporting in nature and carries a rider and possibly one, two, three, or four passengers. A relatively small hull of the personal watercraft commonly defines a rider's-area above an engine compartment. An internal combustion engine-frequently powers a jet propulsion unit which propels the watercraft. The engine is disposed within the engine compartment in front of a tunnel provided on the underside of the watercraft hull. The jet propulsion unit is located within the tunnel and is driven by the engine.

Air ducts typically communicate air into the engine compartment for induction by the engine and to ventilate the engine compartment.

FIG. 8 illustrates a known air duct structure. Each air intake duct 78 includes a rigid pipe 70, made of hard plastic, extending through the deck 16 of hull 12 and terminating at a first end 72. A flange 74 disposed around the pipe 70 abuts a portion of the deck 16. Fasteners, such as rivets 76, for example, extend through the flange 74 and the deck 16 to secure the pipe 70 to the deck 16.

An elbow 78 of the pipe 70 directs the pipe 70 downwardly and slightly forwardly into the engine compartment. A flexible pipe 80 is attached to a second end 82 of the rigid pipe 70 and can be configured so as to communicate with any desired location within the hull 12.

The air duct structure shown in FIG. 8 is quite complicated as seen by the number of parts required to form the duct stricture. Further, this duct structure has a high production cost and is difficult to assemble. More specifically, the flange 74 must be secured to the deck 16 by rivets 76 to secure the air duct structure, and the air duct structure includes two separate pipes 70, 80 that must be joined to each other.

SUMMARY OF THE INVENTION

To overcome the problems described above, preferred embodiments of the present invention provide a duct structure having fewer parts, being less complicated to assemble, and having a reduced production cost as compared to known duct structures.

According to the preferred embodiment of the present invention, a duct structure for a watercraft includes a flexible tube for providing an air intake for the watercraft, and a flexible member for being disposed on an inner perimeter of a hole in a hull of the watercraft for holding the flexible tube.

The flexible member is preferably removably attached to a deck portion of a hull of the watercraft at an inner surface and outer surface of the deck portion.

The flexible tube is preferably a single integral tube member extending through the hull of the watercraft and to an engine area of the watercraft, and is preferably formed of a flexible material such as rubber.

The flexible member preferably includes an exterior concave portion for engaging the hull of the watercraft. The exterior concave portion engages an interior surface and an exterior surface of the hull and fixes the flexible member to the hull. The flexible member does not require additional attaching devices such as rivets to be fixed to the hull of the watercraft as with conventional duct structures.

The flexible member also preferably includes at least one interior concave portion for engaging an exterior convex portion of the flexible tube to reliably hold the flexible tube in place relative to the hull of the watercraft. The at least one interior concave portion of the flexible member extends around an entire circumference of the flexible member and has a substantially semicircular cross section. The at least one concave member of the flexible member is arranged such that the exterior convex portion of the flexible tube engages the at least one concave portion of the flexible member around substantially the entire circumference of the flexible member.

According to another preferred embodiment of the present invention, a duct structure for a watercraft includes a hull of the watercraft having a hole provided therein, a flexible tube providing an air intake for the watercraft, and a flexible member disposed in the hole of the hull for holding the flexible tube.

As with the other preferred embodiment described above, the flexible tube is preferably a single integral tube member extending through the hull of the watercraft and to an engine area of the watercraft.

The flexible tube also includes a convex portion formed by a spring member provided along the flexible tube and the convex portion preferably has a spiral shape. The spring member is preferably made of a wire or a resin or both. The flexible member includes at least one concave portion for engaging the convex portion of the flexible tube.

The at least one concave portion of the flexible member extends around the circumference of the flexible member and has a substantially semicircular cross section. The convex portion of the flexible tube engages the at least one concave portion of the flexible member around substantially the entire circumference of the flexible member. The semicircular cross section of the at least one concave portion of the flexible member has substantially the same radius as the convex portion of the flexible tube.

According to another preferred embodiment of the present invention, a duct structure for a watercraft includes a hull having with a hole provided therein, a flexible tube for providing an air intake for the watercraft, and a holding member disposed in the hole of the hull for fixing the flexible tube to the hull.

The flexible tube preferably includes a convex portion defined by a spring member and the convex portion preferably has a spiral shape. The spring member is preferably made of either a wire or a resin or both.

The flexible tube is preferably of a flexible elastic material.

The flexible tube is preferably a single integral tube member extending through the hull of the watercraft and to an engine area of the watercraft.

The holding member includes a flexible member disposed on an inner perimeter of a hole in a hull of the watercraft for holding the flexible tube. The flexible member includes an exterior concave portion for engaging the hull of the watercraft, the exterior concave portion engages an interior surface and an exterior surface of the hull and fixes the flexible member to the hull.

Any of the preferred embodiments described above can be modified by providing the flexible member with at least one lip extending around the circumference thereof such that the at least one lip contacts the flexible tube between exterior convex portions of the flexible tube. As a result, the lip and the flexible tube form a seal. More preferably, the at least one lip is arranged such that, when the at least one lip contacts the flexible tube, a seal is formed between the flexible member and the deck. Also, it is preferred that the flexible member is symmetric about a plane defined by the inner perimeter of the hole in the hull of the watercraft when the flexible member is disposed in the inner perimeter of the hole in the hull of the watercraft. It should be noted that a plurality of lips could also be provided on the flexible member.

Other features, elements, characteristics, and advantages of the present invention will become more apparent from the following detailed description of the preferred embodiment of the present invention with reference to the attached drawings.

DETAILED DESCRIPTION OF PREFERRED EMBODIMENTS

Figure 1:
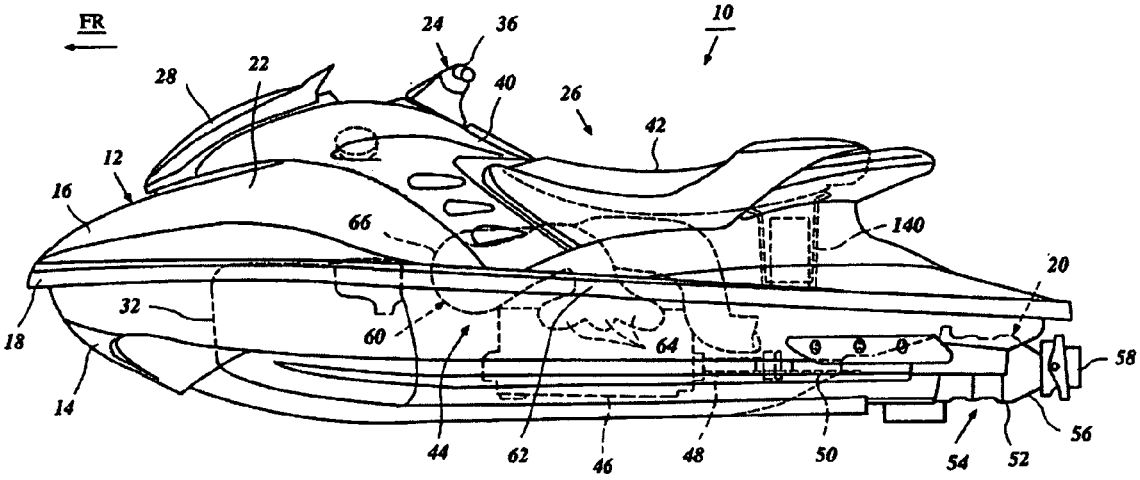
FIG. 1 is side view of a personal watercraft including a duct structure according to a preferred embodiment of the present invention.
Figure 2:
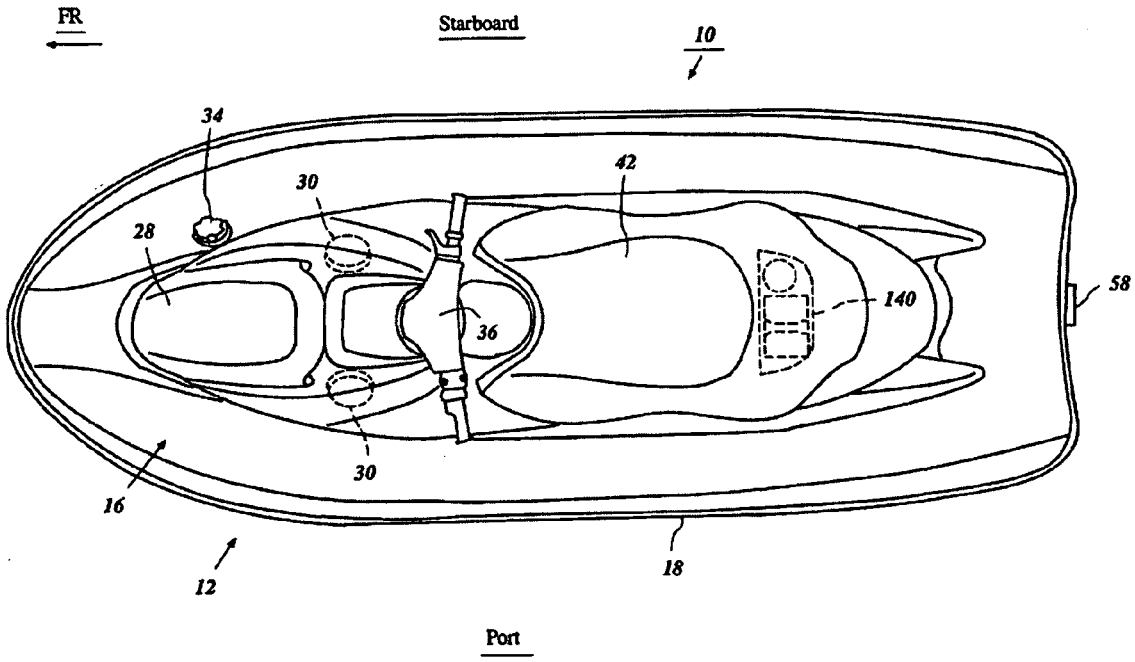
FIG. 2 is top view of the personal watercraft shown in FIG. 1.

FIGS. 1 and 2 illustrate a personal watercraft 10 that includes a duct structure configured in accordance with a preferred embodiment of the present invention. Although these features are illustrated in connection with a personal watercraft, the features can be used with other types of watercraft as well, such as, for example, but without limitation, small jet boats and other suitable watercraft.

The following describes the illustrated watercraft in reference to a coordinate system in order to ease the description of the watercraft 10. A longitudinal axis extends from bow to stem and a lateral axis extends from port side to starboard side perpendicular to the longitudinal axis. A vertical axis extends perpendicular to both the longitudinal axis and the lateral axis. And in FIGS. 1 and 2, a label "Fr" has been included which designates a forward direction for reference purposes.

With reference to FIGS. 1 and 2, the watercraft 10 includes a hull 12 having a lower hull 14 and a deck 16. The lower hull 14 and the deck 16 are formed from a suitable material such as, for example, a molded fiberglass reinforced resin or a sheet molding compound (SMC). The lower hull 14 and the deck 16 are fixed to each other around peripheral edges thereof in any suitable manner.

A bond flange 18 is defined as the overlapping mating section where the lower hull 14 and the deck 16 are joined together. The bond flange 18 also identifies the location of a bond line, which is an imaginary line around the watercraft 10 where the lower hull 14 and the deck 16 are joined together. Accordingly, the deck 16 generally comprises the upper structural body of the watercraft 10, which includes the upper bond flange 18.

The lower hull 14 is designed such that the watercraft 10 planes or rides on a relatively small surface area at the aft end of the lower hull 14 in order to optimize the speed and handling of the watercraft 10 when on plane. For this purpose, the lower hull 14 generally has a V-shaped configuration having a pair of inclined sections that extend outwardly from a keel line of the hull to the hull's side walls at a dead rise angle. The inclined sections also extend longitudinally from the bow toward the transom of the lower hull 14. The side walls are generally flat and straight near the stern of the lower hull and smoothly blend towards the longitudinal center of the watercraft at the bow. The lines of intersection between the inclined section and the corresponding side wall form the outer chines of the lower hull 14.

Toward the transom of the watercraft 10, a recessed channel or tunnel 20 is formed and extends generally upward toward the deck 16 and opens through the rear of the transom of the watercraft 10.

With more specific reference to FIG. 1, the deck 16 includes a bow portion 22, a control mast 24, and a rider's area 26, as viewed in the direction from the bow to the stern of the watercraft 10. The bow portion 22 slopes upwardly toward the control mast 24. A hatch cover 28 desirably extends above a storage compartment provided in the lower hull 14. Air ducts 30 are formed through the deck 16 and allow air to enter and/or exit compartments within the interior of the lower hull 14. The structure and operation of the air ducts 30 will be described in more detail below.

With reference to FIGS. 1 and 2, a fuel tank 32 is located within a forward portion of the hull 12 beneath the hatch cover 28. Conventional members, such as, for example, straps, secure the fuel tank 32 to the lower hull 14. A fuel filler hose (not shown) extends between a fuel cap 34 and the fuel tank 32. The fuel cap 34 is secured to the bow portion 22 of the deck 16 to the side and in front of the control mast 24. A storage box 140 is formed within the hull 12 and under the seat assembly 42. The storage box 140 opens upwardly and is accessible by moving or removing the seat 42.

With reference again to FIGS. 1 and 2, the control mast 24 extends from the bow portion 22 and supports a handlebar assembly 36. The handlebar assembly 36 controls the steering of the watercraft 10 in a conventional manner. The handlebar assembly 36 also carries a variety of controls for the watercraft 10, such as, for example, a throttle control, a start switch, and a lanyard switch. A cowling 40 covers a portion of the deck 16. The deck 16 supports a steering column to which the handlebar assembly 36 is attached, at a point beneath the cowling 40.

A display panel (not shown) desirably is located in front of the control mast 24 on the bow portion 22 and is orientated to be visible by the rider. The display panel desirably displays a number of performance characteristics of the watercraft, such as, for example, watercraft speed (via a speedometer), engine speed (via a tachometer), fuel level, oil level, engine temperature, battery charge level, and other suitable performance characteristics.

The rider's area 26 lies behind the control mast 24 and includes a seat assembly 42. The seat assembly 42 has a longitudinally extending straddle-type shape that may be straddled by an operator and by at least one, two, or three passengers.

At least a portion of the hull defines an engine compartment 44 that is located primarily below the seat 42 and encloses an internal combustion engine 46, which supplies propulsive force to the watercraft 10. The engine 46 preferably is a four cycle, three cylinder, inline engine and is disposed so that its cylinder bores are inclined slightly to one side of vertical. While the illustrated engine is preferably of the four-cycle variety, the engine also can be of the two-cycle or rotary variety as well. Moreover, the engine can have one, two, or more than three cylinders and can be formed with two banks of cylinders.

The engine 46 drives an output shaft 48 that is coupled to an impeller shaft 50. The impeller shaft 50 drives an impeller within an impeller housing assembly 52 of a jet propulsion unit 54, which is mounted within the tunnel 20. The impeller housing assembly 52 also acts as a pressurization chamber and delivers the water flow from the impeller housing to a discharge nozzle 56.

A steering nozzle 58 is supported at the downstream end of the discharge nozzle 56 by a pair of vertically extending pivot pins. The steering nozzle 58 has an integral lever on one side that is coupled to the handlebar assembly 36 through, for example, a bowden-wire actuator, as known in the art. In this manner, the operator of the watercraft 10 can move the steering nozzle 58 to effect directional changes of the watercraft 10.

An exhaust system 60 discharges exhaust byproducts from the engine 46 to the atmosphere and/or to the body of water in which the watercraft 10 is operated. The exhaust system 60 includes an exhaust manifold 62 that is affixed to the side of the engine cylinder block and which receives exhaust gases from the combustion chambers through exhaust ports in a well-known manner. For this purpose, the exhaust manifold 62 desirably includes a number of runners 64 equal in number to the number of cylinders. Each runner communicates with the exhaust port(s) of the respective cylinder. The runners of the exhaust manifold merge at a merge point to form a common exhaust path that terminates at an outlet end of the manifold 62.

An outlet end of the exhaust manifold communicates with an exhaust expansion chamber 66, which wraps around the front side of the engine 46 and extends along an opposite side of the engine 46 to a point just beyond the rear side of the engine 46. The expansion chamber 66 then turns downward and communicates with a water trap (not shown). A discharge conduit (not shown) extends from the water trap in a known manner to an exhaust discharge port formed through the hull in the tunnel.

While not illustrated, the engine also includes an induction system that provides air to each combustion chamber for combustion. The induction system can be configured in any suitable manner and may provide either an air charge (i.e., for direct injection engines or for engines having fuel injected into scavenge passages) or a mixed air-fuel charge (i.e., for indirect injection engines or carbureted engines). Thus, the induction system draws air from the compartments defined within the hull into the engine.

Figure 3:
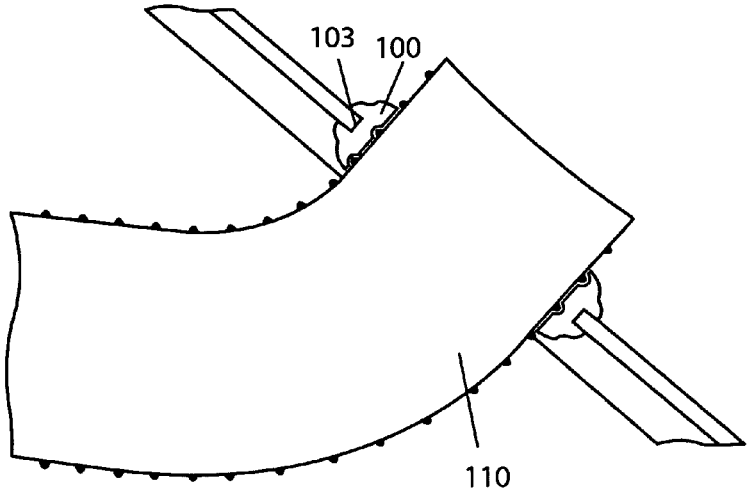
FIG. 3 is a sectional view of the duct structure according to the preferred embodiment of the present invention.
Figure 4:
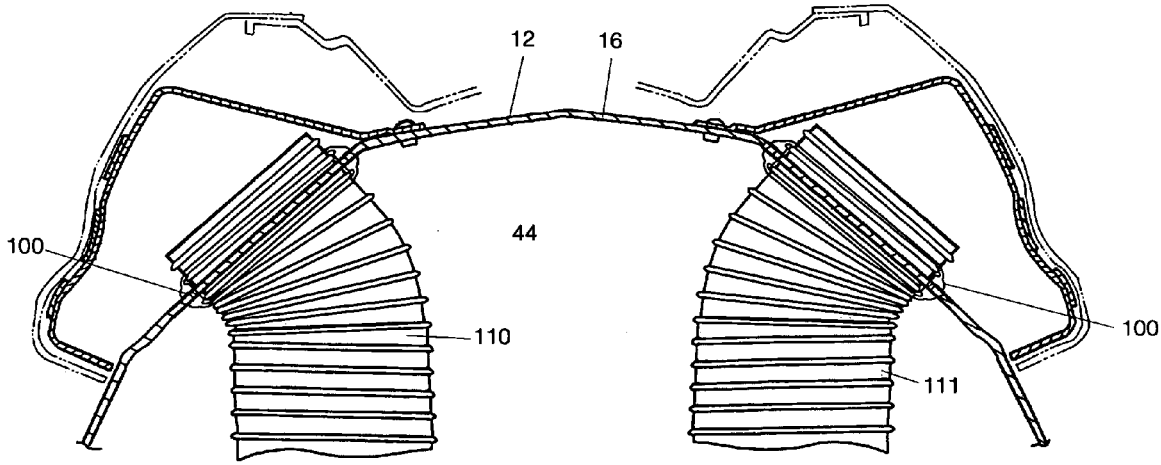
FIG. 4 is sectional view of the hull of a watercraft having the duct structure according to a preferred embodiment of the present invention.

FIGS. 3 and 4 illustrate a structure of the air ducts 30 shown in FIGS. 1 and 2 according to a preferred embodiment of the present invention. The air duct shown in FIGS. 3 and 4 includes a flexible tube 110 attached to the deck 16 of the hull 12 by a gasket 100. As can be seen in FIGS. 3 and 4, the flexible tube 110 is preferably a single, unitary member the is continuously formed and is not made up of two or more separate tubes as with the prior art described above.

Figure 7A:
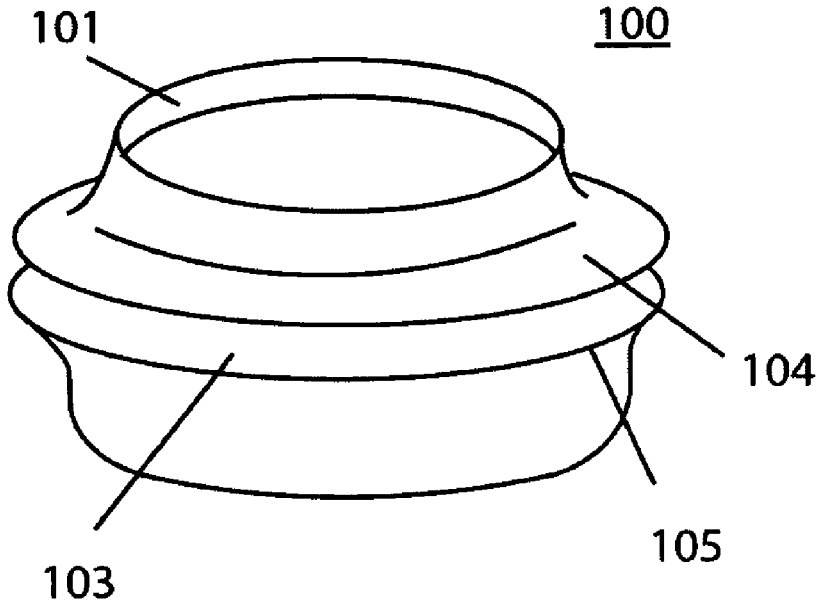
FIG. 7A is a view of the gasket of the duct structure according to a preferred embodiment of the present invention.
Figure 7B:
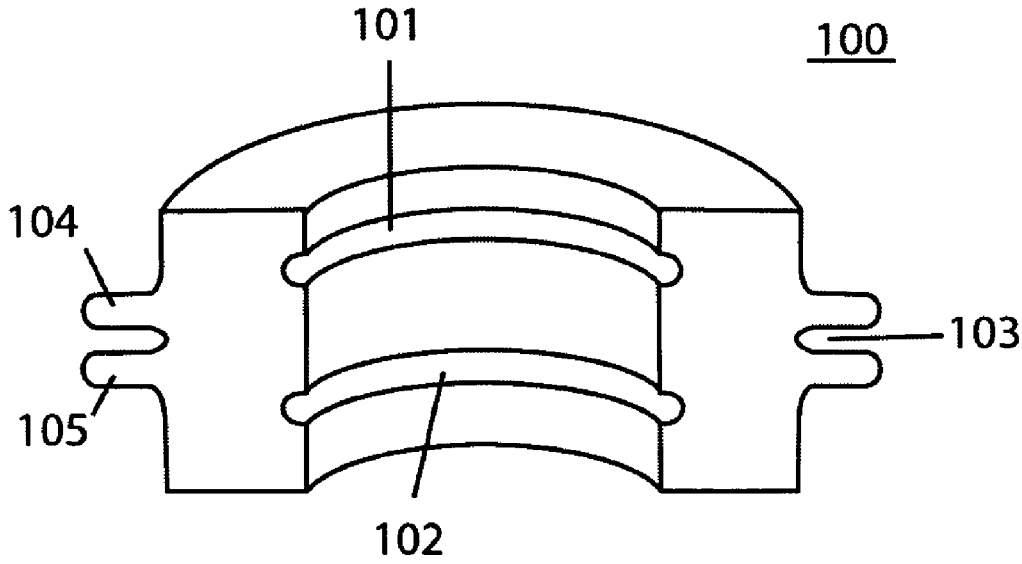
FIG. 7B is sectional view of the gasket of the duct structure according to a preferred embodiment of the present invention.
Figure 8:
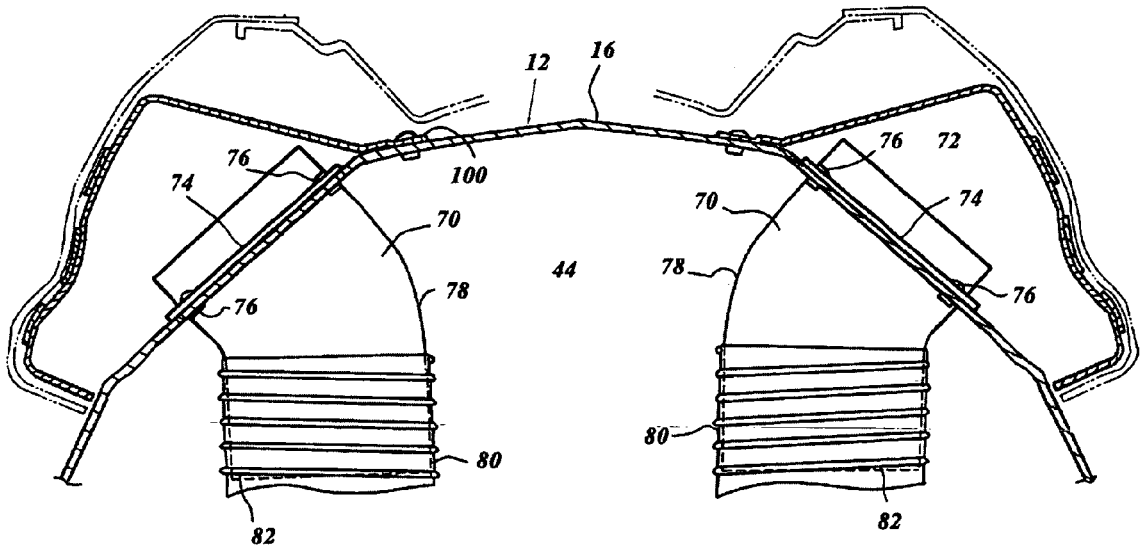
Fig. 8 PRIOR ART
FIG. 8 is sectional view of the hull of a watercraft having a prior art duct structure.

The gasket 100 is disposed on the inner circumference of a hole in the deck 16. As shown in FIGS. 7A and 7B, the gasket 100 includes exterior groove 103 that includes an exterior flange portion 104 and an interior flange portion 105. Exterior groove 103 engages the deck 16 of the hull 12. Exterior flange portion 104 is in contact with the exterior surface of the deck 16, and interior flange portion 105 is in contact with the interior surface of the deck 16.

The gasket 100 further includes a top interior groove 101 and a bottom interior groove 102 which engage the flexible tube 110 to fix it to the hull 12. Gasket 100 is flexible so that is can easily be inserted into the hole of deck 16 and is preferably made of rubber. However, any other suitable flexible material can be used.

With this unique structure including the exterior groove and flange and interior grooves of the gasket 100, it is not necessary to use rivets or other such devices to fix or secure the gasket 100 and tube 110 to the deck 16 of the hull 12, the air duct 30 can be easily and removably fixed to the deck 16 of the hull 12 so assembly is greatly simplified, and the gasket 100 reliably holds the flexible tube 110 in place so the flexible tube 110 is not unexpectedly or undesirably removed.

Figure 6:
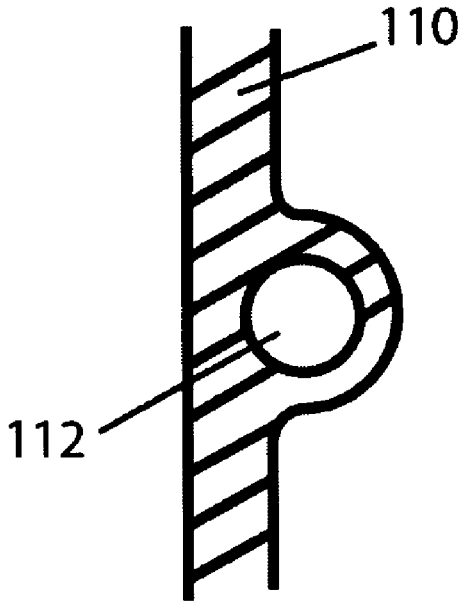
FIG. 6 is sectional view of the flexible tube of the duct structure according to a preferred embodiment of the present invention.

The flexible tube 110 is preferably made of a flexible material such as rubber and is a single integral continuously formed member. Although rubber is preferred, any other suitable flexible material can be used to form the flexible tube 110. The flexible tube 110 preferably includes a spring member 112 for forming a convex portion 111 between adjacent spring members 112, as shown in FIG. 6. The spring member 112 is preferably completely surrounded by the material of the flexible tube 110. Preferably the spring member 112 is formed of metal. However, the spring member 112 could also be formed of a resin, and preferably a nylon resin, or other suitable material, or formed of a metal wire that is covered with a resin.

Figure 5:
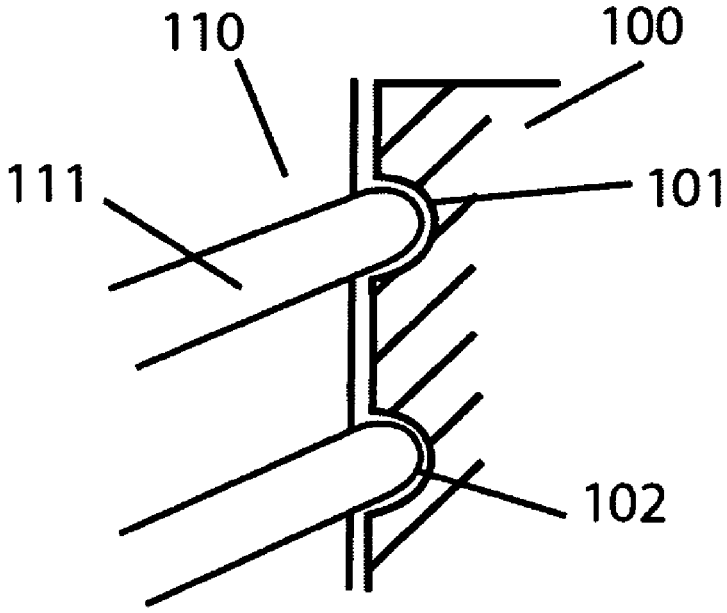
FIG. 5 is close-up sectional view of the duct structure according to the preferred embodiment of the present invention.

The exact manner in which the top interior groove 101 and bottom interior groove 102 engage the flexible tube 110 will now be described. As seen in FIGS. 5 and 7B, the top interior groove 101 and the bottom interior groove 102 each have a recessed or concave configuration, respectively. The recess or concave portions formed by each of the top interior groove 101 and the bottom interior groove 102 preferably extend around the entire circumference of the gasket 100. Preferably, the recess or concave portion formed by each of the top interior groove 101 and the bottom interior groove 102 has a semicircular cross section.

As shown in FIG. 5, the convex portion 111 formed by the spring member 112 of the flexible tube 110 engages the recesses or concave portions formed by the top interior groove 101 and the bottom interior groove 102 of the gasket 100. Preferably, the convex portion 111 of the flexible tube 110 engages the concave portions of gasket 100 around substantially the entire circumference of the gasket 100.

Preferably, the radius of the semicircular cross section of the recesses or concave portions formed by the top interior groove 101 and bottom interior groove 102 of the gasket 100 is slightly greater than the radius of the spring member 112 such that the convex portion 111 of the flexible tube 110 is held firmly and reliably in the concave portion of the gasket 100. Even though the convex portion 111 of the flexible tube 110 is disposed firmly in the concave portion of the gasket 100, the flexible tube 110 can easily be disengaged from the gasket 100 because of the flexible nature of the spring member 112.

The flexible tube 110 can be made to engage the gasket 100 by pulling the tube from the exterior side of the hull 12 through the hole in the deck 16. The flexible tube 110 can be disengaged from the gasket 100 by pulling the tube from interior side of the deck 16.

Figure 9:
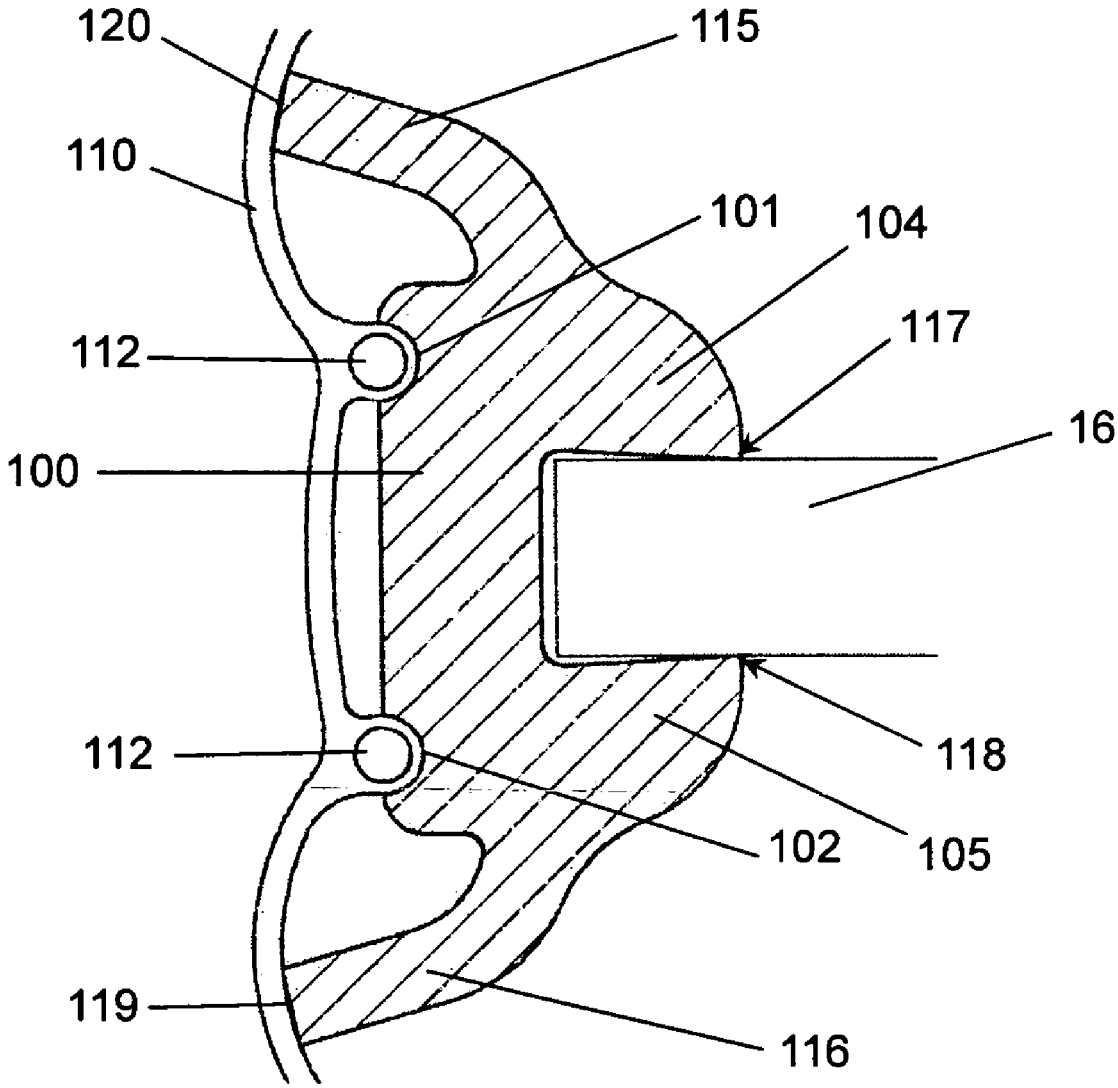
FIG. 9 is sectional view of a modification of the duct structure according to another preferred embodiment of the present invention.

FIG. 9 is sectional view that illustrates a modification to the duct structure according to another preferred embodiment of the present invention. The modification includes at least one lip and more preferably two lips 115 and 116 extending from the top and the bottom of the gasket 100. Lips 115 and 116 extend along the entire circumference of the gasket 100. The lips 115 and 116 extend away from the top and the bottom of the gasket 100 such that the lip ends 119 and 120 of each of the lips 115 and 116 contact the flexible tube 110 between spring members 112. Preferably, the lip 115 and the flexible tube 110 form a seal, and the lip 116 and the flexible tube 110 form another seal.

Preferably, the lips 115 and 116 are arranged such that, when the lip ends 119 and 120 contact the flexible tube 110, pressure is applied to the deck 116 through a contact point 117 on the exterior flange portion 104 and through a contact point 118 on the interior flange portion 105. Preferably, the pressure is sufficient to form a seal between the contact point 117 and the deck 16 and to form another seal between the contact point 118 and the deck 16.

As seen in FIG. 9, the unique structure of the gasket 100 having the lips 115, 116 enables the gasket 100 to be installed in any direction since the gasket 100 is symmetric relative to about a plane defined by the inner perimeter of the hole in the hull of the watercraft when the flexible member is disposed in the inner perimeter of the hole in the hull of the watercraft.

As described above, the unique structure of the air duct according to preferred embodiments of the present invention makes the assembly process much easier and less expensive than conventional devices, and reliably holds the flexible tube in place while also making it easy to assemble and disassemble, as desired.

It should be understood that the foregoing description is only illustrative of the present invention. Various alternatives and modifications can be devised by those skilled in the art without departing from the present invention. Accordingly, the present invention is intended to embrace all such alternatives, modifications and variances which fall within the scope of the appended claims.

What is claimed is:

1. A duct structure for a watercraft comprising:

a flexible tube for providing an air intake for the watercraft; and a flexible member for being disposed on an inner perimeter of a hole in a hull of the watercraft for holding the flexible tube; wherein the flexible tube extends through the hole in the hull; and the flexible member includes an exterior concave portion for engaging the hull of the watercraft, the exterior concave portion engages an interior surface and an exterior surface of the hull and fixes the flexible member to the hull.

2. A duct structure for a watercraft comprising:

a flexible tube for providing an air intake for the watercraft; and a flexible member for being disposed on an inner perimeter of a hole in a hull of the watercraft for holding the flexible tube; wherein the flexible tube extends through the hole in the hull; and the flexible member includes at least one interior concave portion for engaging an exterior convex portion of the flexible tube.

3. A duct structure for a watercraft according to claim 2, wherein the flexible tube is a single integral tube member extending through the hull of the watercraft and to an engine area of the watercraft.

4. A duct structure for a watercraft according to claim 2, wherein the at least one interior concave portion of the flexible member extends around an entire circumference of the flexible member and has a substantially semicircular cross section.

5. A duct structure for a watercraft according to claim 2, wherein the at least one concave portion of the flexible member is arranged such that the exterior convex portion of the flexible tube engages the at least one concave portion of the flexible member around substantially the entire circumference of the flexible member.

6. A duct structure for a watercraft according to claim 2, wherein the flexible member is made of rubber.

7. A duct structure for a watercraft comprising:

a hull of the watercraft having a hole provided therein;

a flexible tube providing an air intake for the watercraft; and a flexible member disposed in the hole of the hull for holding the flexible tube; wherein the flexible tube extends through the hole in the hull; and the flexible tube includes a convex portion formed by a spring member provided along the flexible tube.

8. A duct structure for a watercraft according to claim 7, wherein the flexible tube is a single integral tube member extending through the hull of the watercraft and to an engine area of the watercraft.

9. A duct structure for a watercraft according to claim 7, wherein the convex portion has a spiral shape.

10. A duct structure for a watercraft according to claim 7, wherein the spring member is made of at least one of a wire and a resin.

11. A duct structure for a watercraft comprising:

a hull of the watercraft having a hole provided therein a flexible tube providing an air intake for the watercraft; and a flexible member disposed in the hole of the hull for holding the flexible tube; wherein the flexible tube extends through the hole in the hull; and the flexible tube includes a convex portion and the flexible member includes at least one concave portion for engaging the convex portion of the flexible tube.

12. A duct structure for a watercraft according to claim 11, wherein the convex portion of the flexible tube has a spiral shape.

13. A duct structure for a watercraft according to claim 11, wherein the convex portion of the flexible tube engages the at least one concave portion of the flexible member around substantially the entire circumference of the flexible member.

14. A duct structure for a watercraft according to claim 11, wherein the at least one concave portion of the flexible member extends around the circumference of the flexible member and has a substantially semicircular cross section.

15. A duct structure for a watercraft according to claim 14, wherein the semicircular cross section of the at least one concave portion of the flexible member has substantially the same radius as the convex portion of the flexible tube.

16. A duct structure for a watercraft comprising:

a hull having with a hole provided therein;

a flexible tube for providing an air intake for the watercraft; and a holding member disposed in the hole of the hull for fixing the flexible tube to the hull; wherein the flexible tube extends through the hole in the hull; and the flexible tube includes a convex portion defined by a spring member.

17. A duct structure for a watercraft according to claim 16, wherein the convex portion has a spiral shape.

18. A duct structure for a watercraft according to claim 16, wherein the spring member is made of at least one of a wire and a resin.

19. A duct structure for a watercraft according to claim 16, wherein the flexible tube is made of a flexible elastic material.

20. A duct structure for a watercraft according to claim 16, wherein the flexible tube is a single integral tube member extending through the hull of the watercraft and to an engine area of the watercraft.

21. A duct structure for a watercraft comprising:

a hull having with a hole provided therein;

a flexible tube for providing an air intake for the watercraft; and a holding member disposed in the hole of the hull for fixing the flexible tube to the hull; wherein the flexible tube extends through the hole in the hull;

the holding member includes a flexible member disposed on an inner perimeter of a hole in a hull of the watercraft for holding the flexible tube; and the flexible member includes an exterior concave portion for engaging the hull of the watercraft, the exterior concave portion engages an interior surface and an exterior surface of the hull and fixes the flexible member to the hull.

22. A duct structure for a watercraft comprising:

a flexible tube for providing an air intake for the watercraft; and a flexible member for being disposed on an inner perimeter of a hole in a hull of the watercraft for holding the flexible tube; wherein the flexible tube extends through the hole in the hull; and the flexible member includes at least one lip extending around the circumference thereof, the at least one lip contacts the flexible tube between exterior convex portions of the flexible tube.

23. A duct structure for a watercraft according to claim 22, wherein the at least one lip and the flexible tube form a seal.

24. A duct structure for a watercraft according to claim 22, wherein the at least one lip is arranged such that, when the at least one lip contacts the flexible tube, a seal is formed between the flexible member and the deck.

25. A duct structure for a watercraft according to claim 22, wherein the flexible member is symmetric about a plane defined by the inner perimeter of the hole in the hull of the watercraft when the flexible member is disposed in the inner perimeter of the hole in the hull of the watercraft.

26. A duct structure for a watercraft comprising:

a hull of the watercraft having a hole provided therein;

a flexible tube providing an air intake for the watercraft; and a flexible member disposed in the hole of the hull for holding the flexible tube; wherein the flexible tube extends through the hole in the hull; and the flexible member includes at least one lip extending around the circumference thereof, the at least one lip contacts the flexible tube between exterior convex portions of the flexible tube.

27. A duct structure for a watercraft according to claim 26, wherein the at least one lip and the flexible tube form a seal.

28. A duct structure for a watercraft according to claim 26, wherein the at least one lip is arranged such that, when the at least one lip contacts the flexible tube, a seal is formed between the flexible member and the deck.

29. A duct structure for a watercraft according to claim 26, wherein the flexible member is symmetric about a plane defined by the hole in the hull of the watercraft.

30. A duct structure for a watercraft comprising:

a hull having with a hole provided therein;

a flexible tube for providing an air intake for the watercraft; and a holding member disposed in the hole of the hull for fixing the flexible tube to the hull; wherein the flexible tube extends through the hole in the hull; and the holding member includes at least one lip extending around the circumference thereof, the at least one lip contacts the flexible tube between exterior convex portions of the flexible tube.

31. A duct structure for a watercraft according to claim 30, wherein the at least one lip and the flexible tube form a seal.

32. A duct structure for a watercraft according to claim 30, wherein the at least one lip is arranged such that, when the at least one lip contacts the flexible tube, a seal is formed between the holding member and the deck.

33. A duct structure for a watercraft according to claim 30, wherein the holding member is symmetric about a plane defined by the hole in the hull of the watercraft.

* * * * *